United States Patent [19]

Denis et al.

[11] Patent Number: 4,664,676

[45] Date of Patent: May 12, 1987

[54] ADDITIVES COMPOSITIONS USEFUL IN PARTICULAR FOR IMPROVING THE COLD FILTERABILITY PROPERTIES OF OIL MIDDLE DISTILLATES

[75] Inventors: Jacques Denis, Charbonniere les Bains; Bernard Sillion, Lyons; Bernard Damin, Oullins; Jean-Michel Laupie, Communay, all of France

[73] Assignees: Institut Francais du Petrole, Rueil-Malmaison; Elf France, Paris, both of France

[21] Appl. No.: 753,507

[22] Filed: Jul. 10, 1985

[30] Foreign Application Priority Data

Jul. 10, 1984 [FR] France ..... 84 10979

[51] Int. Cl.[4] ..... C10L 1/16; C10L 1/18

[52] U.S. Cl. ..... 44/62; 44/70; 44/71; 44/72; 252/51.5 A

[58] Field of Search ..... 252/51.5 A; 44/62, 70, 44/71, 72

[56] References Cited

U.S. PATENT DOCUMENTS 4,320,019 3/1982 Hayashi ..... 252/51.5 A
4,357,250 11/1982 Hayashi ..... 252/51.5 A
4,375,973 3/1983 Rossi ..... 252/51.5 A

*Primary Examiner*—Jacqueline V. Howard
*Attorney, Agent, or Firm*—Millen & White

[57] ABSTRACT

Additive compositions, useful in particular for improving the cold filterability properties of oil middle distillates, comprise:

(A) at least one ethylene polymer; and (B) at least one polymeric compound resulting from the condensation of at least one compound comprising a primary amine group, of formula $$R—Z[(CH_2)_n NH]_m H \text{ or } HO—CH_2—R''—NH_2$$

wherein R is an alkyl from $C_1$ to $C_{30}$, Z is —NH—, —NR'— or —O—, R' being a $C_1$-$C_{30}$ alkyl, n an integrer from 2 to 4 , m an integrer from 1 to 4 (or zero when Z is —NH—), R'' is a $C_1$-$C_{18}$ alkylene, with a copolymer of a linear $\alpha$-olefin, of an unsaturated $\alpha$, $\beta$-dicarboxylic compound and of an alkyl ester of an unsaturated monocarboxylic acid, or a vinyl ester of a saturated monocarboxylic acid.

These additive compositions, used for example at concentrations from 50 to 500 g/m$^3$, have a synergic effect on the filterability limit temperature of the middle distillates, particularly gas-oils.

19 Claims, No Drawings

ADDITIVES COMPOSITIONS USEFUL IN PARTICULAR FOR IMPROVING THE COLD FILTERABILITY PROPERTIES OF OIL MIDDLE DISTILLATES

The invention concerns the combined use of additives having synergism properties, to improve the cold filterability of oil middle distillates, particularly gas-oils. It also concerns the oil middle distillates compositions comprising such additive combinations.

The additive combinations according to the invention confer to the middle distillates to which they are incorporated very good general properties at temperatures.

BACKGROUND OF THE INVENTION

Many compounds have been proposed, in the prior art, as additives for improving the behavior at temperatures and more particularly the properties of cold filterability of oil middle distillates.

They may consist of mere polymers such as, for example, ethylene homopolymers. Some of them are mentioned, by way of example, in the West-German Patent DE No. 856,682 and the U.S. Pat. No. 3,640,824, both describing the use of branched polyethylenes of high number molecular weight, whereas the british patent GB No. 847,777 and the U.S. Pat. No. 3,454,379 recommended, on the contrary, the use of branched polyethylenes of low number molecular weight (lower than 5,000).

However, the use of only branched polyethylene is not sufficient to obtain satisfactory properties of cold filterability; this is also true for the use of various copolymers of ethylene with another co-monomer such, for example, as vinyl acetate, α-olefins, esters or diesters having an olefinic double bond.

Much better results concerning the improvement of cold filterability of oil middle distillates have been obtained by using mixtures of additives.

Among the numerous disclosed compositions, those which do not comprise polyethylene as homopolymer or as a co-polymer may be first mentioned. Thus the French patent FR No. 2,347,435 discloses the synergic action of an alkyl-aromatic derivative associated either to a hydrogenated 1,4-polybutadiene or to a hydrogenated copolymer of 1,4 polybutadiene with a second dialkene compound. U.S. Pat. No. 2,917,375 indicates the synergic properties of micro-crystalline paraffin waxes admixed with acrylic and/or methacrylic polymers. U.S. Pat. No. 4,140,492 mentions the synergic action of two compounds: the first one results from the action of boron compounds on Mannich bases of phenol compounds, while the second may be an amorphous hydrocarbon or a hydrogenated polybutadiene.

Compositions wherein one of the constituents is an ethylene copolymer may also be mentioned. By way of example, U.S. Pat. No. 3,660,057 discloses the association of hydrocarbon fractions free of n-paraffins which copolymers of ethylene and α-olefins of 3 to 16 carbon atoms, or with copolymers of ethylene and acids, anhydrides or esters having an olefinic double bound. The U.S. Pat. No. 3,640,691 discloses the association of a minor paraffinic fraction, containing n-paraffins of 24–40 carbon atoms with ethylene/vinyl acetate copolymers. French Pat. No. 2,061,457 associates two copolymers of ethylene and vinyl acetate of different molecular weights. Japanese patent JP No. 57,209,995 discloses a synergic action between a residual heavy oil and a copolymer of ethylene with an ester of a carboxylic acid having ethylenic bonds. The European patent EP No. 0,074,208 discloses a synergic action on the filterability limit temperature of fuel oils between, on the one hand, a copolymer of ethylene and alkoxyalkyl(meth)acrylate and, on the other hand, a copolymer of ethylene associated either with a vinyl ether or with an alkyl ether of unsaturated acid.

U.S. Pat. No. 3,961,916 teaches the synergism between two copolymers both composed of ethylene, copolymerized either with vinyl esters or with alkyl(meth)acrylates. U.S. Pat. No. 4,153,424 discloses the synergic effect of a copolymer of ethylene and alkyl acrylates associated with a homo- or copolymer of alkyl acrylate and/or methacrylate. Among these types of compositions having a synergic action, were also described compositions comprising three different compounds. Thus, the Japanese patent JP No. 56,043,391 discloses the synergic action of a chlorinated polyethylene, a branched polyethylene, an alkenyl-succinamide. U.S. Pat. No. 3,892,909 teaches a synergic effect of three compounds:

(A) A mono-amide or mono-esterified derivative of an unsaturated dicarboxylic acid;

(B) A copolymer of ethylene with an ester of an unsaturated mono- or di-carboxylic acid, a $C_3$–$C_{16}$ α-olefin or vinyl chloride; and, (C) A micro-crystalline wax free of n-paraffins, or an alkyl aromatic compound.

Finally, compositions wherein one of the constituents is polyethylene can be mentioned.

Thus, U.S. Pat. No. 3,640,824 discloses the association of a highly branched polyethylene of number molecular weight higher than 6,000 with a micro-crystalline wax and/or with naphthalene and/or asphaltenes.

U.S. Pat. No. 3,661,541 mentions the synergism betweeen:

(A) polyethylene or a copolymer of ethylene with a 3–18 carbon atoms α-olefin, and (B) a copolymer of ethylene with an unsaturated carboxylic monoester.

French patent FR No. 2,305,493 teaches the synergism between two compounds (A) and (B):

(A) being either polyethylene or a copolymer of ethylene with esters having ethylenic unsaturations, and (B) being an alkyl poly(meth)acrylate.

French patent FR No. 2,324,711 indicates the syngergism between:

(A) polyethylene or chlorinated polyethylene or a copolymer of ethylene with an α-olefin or vinyl or (meth)acrylic ester, and (B) sulfonated copolymers obtained by reacting sulfurous anhydride with α-olefins mixtures.

French patent FR No. 2,305,492 discloses the synergism between:

(A) polyethylene or a copolymer of ethylene with either a vinyl ether, or an alkyl(meth)acrylate, or an α-olefin, and (B) alkyl poly(meth)acrylates.

U.S. Pat. No. 3,166,387 discloses the synergic action of polyethylene of low molecular weight associated with a secondary or tertiary amine salt of carboxylic acid.

French patent FR No. 2,490,669 discloses a synergic composition formed from:

(A) polyethylene or chlorinated polyethylene or a copolymer formed from ethylene and alkyl acrylate or vinyl acetate or still a hydrogenated copolymer of butadiene and isoprene, and (B) the reaction product of linear N-alkyl polyamines with saturated or unsaturated cyclic anhydrides, optionally substituted with a hydrocarbon group comprising 1 to 6 carbon atoms.

U.S. Pat. No. 4,019,878 discloses a composition having a synergic effect, formed by:

(A) polyethylene or chlorinated polyethylene or a copolymer of ethylene with either an α-olefin or an unsaturated monoester, or an unsaturated diester, (B) bees-wax or ozokerite or a mixture of α-olefins havins 24 to 50 carbon atoms.

U.S. Pat. No. 4,175,926 indicates a composition having a synergic effect, obtained from:

(A) polyethylene or a copolymer of ethylene with unsaturated mono or diester, and (B) either polymerized α-olefins, or a copolymer of dialkyl fumarate with either vinyl acetate or alkyl methacrylate.

British patent BG No. 1,469,016 mentions a synergic mixture consisting of:

(A) a polyethylene or chlorinated polyethylene or copolymer of ethylene with an unsaturated mono or diester, an α-olefin or vinyl chloride, (B) a polymer or copolymer derivating from at least one of the alkyl diesters of unsaturated carboxylic diacids and α-olefins.

Japanese patent JP No. 54,086,505 teaches a composition having a synergic effect, prepared from:

(A) a polyethylene, a chlorinated polyethylene, a copolymer of ethylene/vinyl acetate or a compound of alkyl aromatic type; and (B) a copolymer obtained from a N,N'-dialkyl maleamide derivative and an α-olefin of 8–30 carbon atoms.

However, none of these compositions is able to confer to the oil middle distillates, and particularly to gas-oils and fuel-oils, satisfactory properties at cold temperatures, as a whole.

On the other hand, the applicants have previously described certain additives which, by a mechanism not yet clear, may reduce the temperature of formation of the first paraffin crystals (particularly in the French patent application FR No. 2,528,066, filed on June 4, 1982). Briefly stated, this additive may be described as the product obtained by reaction, of a terpolymer comprising:

(a) at least one linear α-olefin (b) at least one unsaturated α,β-dicarboxylic compound, such as diacid, light alkyl diester or anhydride, and (c) at least one alkyl ester of an unsaturated monocarboxylic acid;

with at least one compound with a primary amine group complying with one of the general formulas:

$$R-Z[(CH_2)_n NH]_m H \quad (I)$$

and $$HO-CH_2-R''-NH_2 \quad (II)$$

wherein R is a saturated aliphatic monovalent radical of 1–30 carbon atoms, Z is selected from —NH—, or —NR'— groups, wherein R' is a saturated aliphatic monovalent radical of 1–30 carbon atoms, and the oxygen atom —O—, n is an integer from 2 to 4, m is zero or an integer from 1 to 4; and R'' is a saturated aliphatic divalent radical of 1–18 carbon atoms.

These additives, when added to gas-oil cuts, for example at concentrations of about 0.1% by weight, have shown a favorable action, mainly on the cloud point thereof, but also on their filterability limit temperature as well as on their pour point temperature.

SUMMARY OF THE INVENTION

It has now been discovered that it was possible to more clearly improve the cold filterability properties of oil middle distillates, having distillation ranges, according to ASTM-D-1160 distillation Standard, between initial temperatures of 160° to 235° C. and final temperatures of 355° to 440° C., (based on atmospheric pressure) by using certain combinations of products which are described hereinafter.

Generally, the additives compositions considered in this invention, may be defined as mainly comprising:

a constituent (A) which is at least one ethylene polymer, and a constituent (B) which is at least one polymeric compound which may be defined as resulting from the condensation of at least one compound with a primary amine group such as hereinafter defined, with a copolymer comprising:

(a) recurrent units from at least one linear α-olefin, (b) recurrent units derived from at least one unsaturated α,β-dicarboxylic compound, such as a diacid, light alkyl diester or anhydride; and (c) recurrent unit from at least one alkyl ester of an unsaturated aliphatic monocarboxylic acid or from at least one vinyl ester of a saturated aliphatic monocarboxylic acid.

The clear improvement in cold filterability properties of wide or narrow gas-oil cuts to which were added the additive combinations according to the invention, is a quite unexpected result when considering that singly each of the constituents has only a very slight effect on the filterability properties.

More particularly, constituent (A) of the additive compositions of the invention may be at least one ethylene polymer having a number average molecular weight from 500 to 15,000 preferably from 1,000 to 5,000, and a structure corresponding to the general formula:

$$CH_3[(CH_2)_m-\underset{\underset{CH_3}{|}}{CH}-(CH_2)_n]_p CH=CH_2$$

wherein:

m and n are integers from 1 to 20, the sum (m+n) ranging for example from about 9 to 34, and p is an integer from 3 to 30.

Constituent (B) has preferably a number average molecular weight from 1 000 to 10 000.

The copolymers used in the formation of constituent (B) comprise more particularly a proportion from 15 to 40% by mole of recurrent units derived from α-olefins, 20–70% by mole of recurrent units derived from unsaturated α,β-dicarboxylic compounds and 15–40% by mole of recurrent units derived from alkyl esters of unsaturated monocarboxylic acids.

The linear α-olefins comprised in the composition of the polymers contain for example 16–30 carbon atoms. Mixtures of linear α-olefins of 20–24 carbon atoms, of 24–28 carbon atoms or cuts of about 20% by weight of α-olefins of 28 carbon atoms or less and about 80% by weight of α-olefins of 30 carbon atoms or more, are advantageously used.

The unsaturated α,β-dicarboxylic compounds comprised in the composition of the copolymer are more particularly dicarboxylic acids such as maleic acid or alkylmaleic acids, for example methylmaleic (or citraconic) acid.

These compounds may also be alkyl diesters of said dicarboxylic acids, particularly methyl, ethyl or propyl diesters, or the anhydrides corresponding to said dicarboxylic acids. Anhydrides are preferred, more particularly maleic anhydride.

Alkyl esters of unsaturated monocarboxylic acids are more particularly alkyl acrylates and methacrylates, alkyl being in $C_{4-30}$ for example, butyl, ethylhexyl, decyl, dodecyl, hexadecyl, octadecyl and eicosyl acrylates. Acrylates and methacrylates of industrial alcohol cuts containing, as an average, 12 carbon atoms (lauryl acrylate and methacrylate) or 18 carbon atoms (stearyl acrylate and methacrylate) and heavier alcohol cuts, of high content of alcohols having 20–22 carbon atoms, may also be mentioned.

Vinyl esters of saturated aliphatic monocarboxylic acids are more particularly those vinyl esters of monocarboxylic acids having 2 to 22 carbon atoms, such for example as vinyl acetate, propionate, butyrate or vinyl stearate.

The compound with the primary amine group which is condensed with the above-described copolymers to form constituent (B) of the additives compositions according to the invention, may comply with one of the two following general formulas:

$$R—Z[(CH_2)_nNH]_mH \quad (I)$$

$$HO—CH_2—R''—NH_2 \quad (II)$$

In formula (I),

R is a saturated aliphatic monovalent radical containing 1 to 30 carbon atoms;

Z may be either an oxygen atom or a divalent —NH— or —NR'— group, R' being a monovalent aliphatic radical, preferably linear, comprising 1 to 30 carbon atoms and preferentially 12 to 24 carbon atoms, n is an integer from 2 to 4, and m is an integer from 1 to 4, or may also be zero, when Z is NH.

The compounds of formula (I), may consist of primary amines of the formula $R—NH_2$ (then, in formula (I), Z is the —NH— group, and m is zero).

Preferably, radical R is linear and contains 12 to 24 carbon atoms. Specific examples of said amines are: dodecylamine, tetradecylamine, hexadecylamine, octadecylamine, eicosylamine and docosylamine.

Compounds of formula (I) may also consist of polyamines derived from saturated aliphatic amines complying with the formula:

$$R—NH[(CH_2)_nNH]_mH$$

which corresponds to the general formula (I) wherein Z is the —NH— group; m may range from 1 to 4 and n from 2 to 4, with a preferred value of 3.

Preferably, radical R is linear and contains 12–24 carbon atoms Specific compounds are: N-dodecyl-1,3-diamino propane, N-tetradecyl 1,3-diamino propane. N-hexadecyl 1,3-diamino propane, N-octadecyl 1,3-diamino propane, N-eicosyl 1,3-diamino propane, N-docosyl 1,3-diamino propane, N-hexadecyldipropylene triamine, N-octadecyl dipropylene triamine, N-eicosyldipropylene triamine and N-docosyldipropylene triamine.

The compounds of formula (I) may also consist of polyamines complying with the formula:

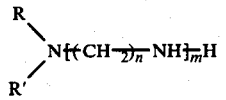

corresponding to the general formula (I) where Z represents —NR'— and where R and R', identical or different, are each an alkyl radical having 1 to 24 and preferably 8 to 24 carbon atoms, R and R' having together preferably from 16 to 32 carbon atoms; the value of n is from 2 to 4 and the value of m from 1 to 4.

Examples of specific compounds are: N,N-diethyl 1,2-diamino ethane, N,N-diisopropyl 1,2-diamino ethane, N,N-dibutyl 1,2-diamino ethane, N,N-diethyl 1,4-diamino butane, N,N-dimethyl 1,3-diamino propane, N,N-diethyl 1,3-diamino propane, N,N-dioctyl 1,3-diamino propane, N,N-didecyl 1,3-diamino propane, N,N-didodecyl 1,3-diamino propane, N,N-ditetradecyl 1,3-diamino propane, N,N-dihexadecyl 1,3-diamino propane, N,N-dioctadecyl 1,3-diamino propane, N,N-diodecyldipropylenetriamine, N,N-ditetradecyldipropylenetriamine, N,N-dihexadecyldipropylenetriamine and N,N-dioctadecyldipropylenetriamine.

Finally, the compounds of formula (I) may consist of ether-amines, more particularly those complying with the formula:

$$R—O[(CH_2)_nNH]_mH$$

which corresponds to the general formula (I) wherein Z is an oxygen atom; preferably radical R is linear and contains 12–24 carbon atoms, m is an integer from 1 to 4, and n an integer from 2 to 4, preferably 2 or 3.

Specific examples of ether-amines are: 2-methoxy ethylamine, 3-methoxy propylamine, 4-methoxy butylamine, 3-ethoxy propylamine, 3-octyloxy propylamine, 3-decyloxy propylamine, 3-hexadecyloxy propylamine, 3-eicosyloxy propylamine, 3-docosyloxy propylamine, N-(3-octyloxy propyl)1,3-diamino propane, N-(3-decyloxy propyl) 1,3-diamino propane, (2,4,6-trimethyl decyl)3-oxy propylamine and N-[2,4,6-trimethyl decyl) 3-oxypropyl]1,3-diamino propane.

The compound with primary amine group involved in the manufacture of constituent (B) of the additives compositions according to the invention may also consist of an aminoalcohol of formula (II):

$$HO—CH_2—R''—NH_2 \quad (II)$$

wherein R'' is a linear or branched, saturated divalent aliphatic radical, preferably linear, containing 1 to 18 carbon atoms.

Specific examples are: monoethanolamine, 1-amino 3-propanol, 1-amino 4-butanol, 1-amino 5-pentanol, 1-amino 6-hexanol, 1-amino 7-heptanol, 1-amino 8-octanol, 1-amino 10-decanol, 1-amino 11-undecanol, 1-amino 13-tridecanol, 1-amino 14-tetradecanol, 1-amino 16-hexadecanol, 2-amino 2-methyl 1-propanol, 2-amino 1-butanol and 2-amino 1-pentanol.

It must be understood that constituent (B) may consist of one or more compounds complying with formula (I) and/or one or more compounds complying with formula (II).

The preparation of constituents (B) of the additive compositions according to the invention is generally performed in two steps: first the preparation of terpolymers, followed with the condensation thereon of the compound of formula (I) and/or (II).

The terpolymers may be prepared, in a first step, according to conventional methods of radical polymerization, for example in the presence of an initiator of the azobiisobutyronitrile or peroxide type, in solution in a hydrocarbon solvent, such for example as: cyclohexane, isooctane, dodecane, benzene, toluene, xylene, diisopropylbenzene, tetrahydrofuran or dioxane.

The use of hydrocarbon cuts of relatively high boiling point, such as kerosene or a gas-oil, is advantageous. The amount of solvent will generally be such that the concentration by weight of dry material ranges from 25 to 70% and is preferably about 60%.

The copolymerization reaction is the presence of the radical initiator is conducted at a temperature of 70°-200° C., preferably 80°-130° C. In the operating conditions, the reaction may last from 2 to 14 hours. A copolymer solution is obtained as viscous liquid a light yellow color.

Then, in a second step, the compound of formula (I) or (II) is condensed on the copolymer formed in the first step, according to any usual method.

Generally, the compound of formula (I) or (II) is added to the copolymer solution, obtained as above described, in a molar proportion corresponding substantially to the proportion of diacid, diester, or unsaturated anhydride involved in the manufacture of the copolymer. This proportion may, for example, range from 0.9 to 1.1 mole of compound (I) or (II) per mole of dicarboxylic compound. It is also possible to use compound (I) or (II) in a much lower proportion, which may be as low as, for example, 0.5 mole per mole of dicarboxylic compound involved in the copolymer.

The reaction is conducted by heating the mixture at a temperature from 75° to 130° C., preferably from 80° to 100° C., the reaction time being from about 1 to 6 hours, generally 2 hours being sufficient.

The reaction of products of formula (I) or (II) on recurrent units (b) of the copolymer, gives rise to imides (succinimides) groups, this reaction being accompanied with the formation of water or alcohol, depending on the nature of the dicarboxylic functions of (b) (diacid, anhydride or diester). The volatile products formed may be, if so desired, driven away outside the reaction mixture by means of an inert gas such, for example, as nitrogen or by azeotropic distillation with the selected solvent.

Another particular mode of synthesis of constituents (B) of the additive compositions according to the invention may consist, sometimes, in the radical copolymerization of one or more alkyl esters of unsaturated monocarboxylic acids or vinyl ester of saturated monocarboxlyic acid, with a mixture of α-olefins and N-substituted maleimides, the latter being obtained by previously reacting compounds of formula (I) or (II) with maleic anhydride or one of its above-mentioned derivatives.

As above-mentioned, the additive compositions of the invention, comprising at least one constituent (A) and at least one constituent (B) such as precedingly defined, are used particularly to improve the cold filterability properties of oil middle distillates with respect to which each of constituents (A) and (B), considered separately, has but a very reduced effect. It thus seems that each of the constituents (A) and (B) has an effective synergism action on the properties of the other, the mechanism of which is not very clear.

Generally, this action appears substantial when the ratio between the amounts by weight of constituents (A) and (B) ranges from 1/20 to 20/1 and, preferentially, from 1/5 to 5/1.

In order to obtain a clear improvement in the cold filterability properties of the gas-oil cuts considered in this invention, the combinations of additives (A) and (B) are generally added to these gas-oil cuts at total concentrations by weight ranging from 20 to 2000 ppm and, more particularly from 50 to 500 ppm. In the gas-oil formulations according to the invention, it is possible to add constituents (A) and (B) directly to the gas-oil by a mere mixing operation.

However, it is often advantageous to introduce them as previously prepared "mother solutions": these mother-solutions may be either two separate solutions in the same solvent or in two different solvents, or a solution of the two constituents. The one or more solvents may consist for example of aromatic solvents such for example as toluene, xylenes, di-isopropylbenzene or of an oil cut of aromatic type within the desired distillation range.

The "mother-solutions" may contain for example 20-60% by weight of additives.

Moreover, it is observed, as a remarkable feature, that the additive compositions of the invention, which are efficient, in contrast to the conventional additives, in wide cuts, i.e. those having for example a distillation range from 160° to 370° C. and more, on the one hand are still efficient when used in a "narrow" cut, having for example a distillation range from 225° to 360° C. and more, i.e. a wide cut from which the light (kerosene) fraction has been removed, and, on the other hand, simultaneously inhibit the settling of n-paraffins in doped gas-oils at rest, although the considered n-paraffins are the heavier n-paraffins of the crude distillable fraction.

This result is the more surprising as it is the light fraction which has a very favorable influence on the filterability temperature and on the parrafins solvation.

The compositions of the invention hence provide for a considerable improvement in the cold filterability properties of oil middle distillates, whereby gas-oil and fuels from distillates cuts of higher final boiling point can be used, which represents an obvious economical advantage.

EXAMPLES

The following examples illustrate the invention but must not be considered in any way as limiting the scope thereof.

In the examples, the gas-oil cuts are those specified in Table I; they are characterized by the ASTM-D-1160 distillation Standard; their density is also indicated in Table I. One of them is a "narrow", one other a wide cut and the others are intermediary cuts. They are designed by references G1, . . . G6.

Concentrations of components (A) and (B) of the additives are in proportions by weight of pure products expressed in parts per million (ppm), being it understood that the compositions may be used in dilute state.

Determinations of filterability limit temperature (F.L.T.) are conducted according to the European standard EN 116 of August 1981.

TABLE I

| GAS OIL CUT No | DISTALLATION ASTM D 1160 Initial point in °C. | final point in °C. | distilled volume at 350° C., % | DENSITY at 15° C. in kg/l |
|---|---|---|---|---|
| $G_1$ | 184 | 385 | 85 | 0.8527 |
| $G_2$ | 205 | 375 | 90 | 0.8486 |
| $G_3$ (narrow cut) | 225 | 384 | 82 | 0.8502 |
| $G_4$ | 184 | 368 | 93 | 0.8439 |
| $G_5$ | 205 | 415 | 83 | 0.8507 |
| $G_6$ (wide cut) | 160 | 378 | 90 | 0.8380 |

EXAMPLE 1

In this example, additives compositions have been used in four gas-oil cuts $G_1$, $G_2$, $G_3$ and $G_4$.

As constituents (A), two ethylene polymers $A_1$ and $A_2$ have been used, which have the following characteristics:

| | $A_1$ | $A_2$ |
|---|---|---|
| Average molecular weight | 2725 | 3000 |
| Branching rate (number of $CH_3$ per 100 carbon atoms) | 9 | 11 |

Constituent (B) was a condensation product of a terpolymer with a fatty amine, which will be called $B_1$. The terpolymer is one molar equivalent of a $C_{20-24}$ α-olefins cut of $\overline{M}_n=295$ comprising, by moles, about 1% of $C_{18}$ olefin, 49% of $C_{20}$ olefins, 42% of $C_{22}$ olefins and 8% of $C_{24}$ olefins, of one molar equivalent of an alcohols methacrylate cut whose composition is the following by weight: 2% of $C_{14}$, 15% of $C_{16}$, 30% of $C_{18}$, 14% of $C_{20}$, and 3% of $C_{22}$, called stearyl methacrylate (SMA) of $\overline{M}_n=326$, and of one mole of maleic anhydride, this terpolymer being prepared by stirring and heating at 130° C. for 4 hours, in 250 ml of a solvent consisting of an oil cut distilling between 120° and 250° C. and with a continuous introduction, during 4 hours, of about 0.003 mole per double bond of benzoyl peroxide diluted with a small amount of solvent.

The number average molecular weight of the terpolymer is 2470.

The fatty amine is a cut of primary amines whose alkyl chains comprise, in approximate molar proportions: 1% of $C_{14}$, 28% of $C_{16}$ and 71% of $C_{18}$. It is used in a proportion of one molar equivalent. The condensation of the amine on the terpolymer is performed by heating at 90° C. for 2 hours. The obtained solution, adjusted to 50% by weight of dry material, forms the mother solution of $B_1$.

The filterability limit temperature of each of the gas-oil cuts without additives or with the additives indicated in Table II hereinafter, have been determined (the F.L.T. are in °C.).

TABLE II

| Test | gas-oil cut | $G_1$ cut | $G_2$ cut | $G_3$ cut | $G_4$ cut |
|---|---|---|---|---|---|
| 1 a | without additive | +2 | +1 | +7 | −1 |
| 1 b | 100 ppm of $A_1$ | −3 | −3 | 0 | −4 |
| 1 c | 100 ppm of $A_2$ | −2 | −3 | +1 | −6 |
| 1 d | 100 ppm of $B_1$ | +1 | 0 | +3 | 0 |
| 1 e | 50 ppm of $A_1$ + 50 ppm of $B_1$ | −8 | −10 | −7 | −17 |
| 1 f | 50 ppm of $A_2$ + 50 ppm of $B_1$ | −7 | −12 | −6 | −15 |

These values of filterability limit temperature for each of the treated gas-oil cuts show that the decreases obtained with mixtures $A_1+B_1$ according to the invention are very substantially higher than the values to be expected (synergism effect).

EXAMPLE 2

In this example, the proportions of the mixture of the two constituents $A_1$ and $B_1$ described in example 1 are varied. The gas-oil is the $C_4$ cut whose characteristics are given in Table I.

The total concentration of additives $A_1+B_1$ in the gas-oil is 100 ppm.

Table III gives the determined F.L.T. values for the various tests; also the values obtained for the $C_4$ gas-oil cut of example 1 are reported (tests 2a, 2b, 2g, 2d, corresponding to tests 1a, 1b, 1d and 1e, respectively).

TABLE III

| Test | Constituent $A_1$ (ppm) | Constituent $B_1$ (ppm) | FLT (°C.) |
|---|---|---|---|
| 2 a | 0 | 0 | −1 |
| 2 b | 100 | 0 | −4 |
| 2 c | 70 | 30 | −18 |
| 2 d | 50 | 50 | −17 |
| 2 e | 40 | 60 | −15 |
| 2 f | 25 | 75 | −10 |
| 2 g | 0 | 100 | 0 |

The synergic effect of constituents $A_1$ and $B_1$ appear obviously from these results.

EXAMPLE 3

The gas-oil $G_1$ described in Table I is used in this example. The additive is a mixture of compound $A_2$ and compound $B_1$, such as described in example 1, used in a proportion by weight $A_2/B_1=75/25$.

In this example, the total additive concentration is varied. Table IV indicates the results obtained for the FLT.

TABLE IV

| Tests | 3a | 3b | 3c |
|---|---|---|---|
| Additives concentration (ppm) | 0 | 100 | 200 |
| F.L.T. (°C.) | +2 | −15 | −18 |

EXAMPLE 4

By way of comparison, three gas-oils $G_3$ (narrow cut), $G_4$ and $G_5$ have been treated with three additives 1, 2 and 3 at a concentration of 50 ppm.

Additives 1 and 2 correspond to conventional additives of the trade. Additive 3 corresponds to the composition of the additive according to the invention, as described in example 3.

The FLT values are given in the following table V (in °C.)

TABLE V

| Test | Additives | $G_3$ gas-oil | $G_4$ gas oil | $G_5$ gas oil |
|---|---|---|---|---|
| 4 a | without | +7 | −1 | +1 |
| 4 b | 1 | 0 | −8 | −4 |
| 4 c | 2 | +2 | −8 | −8 |
| 4 d | 3 | −2 | −10 | −7 |

As a whole, the results are better with additive 3 according to the invention than with additives 1 and 2 of the trade.

EXAMPLE 5

Three test tubes of 100 cc are filled with the cut $G_5$.

In the first test tube, no additive is introduced. In the second test tube 100 ppm of the conventional additive of the trade are introduced.

In the third test tube, 100 ppm of the additive composition as described in example 3 are introduced.

The three test tubes are tightly sealed and maintained at rest in cold storage at −10° C. for one week. After one week, the settling rate of the precipitated paraffins is that given in the following table:

TABLE VI

| Test tube no 1 (without additive Test 5 a | Test tube no 2 (conventional additive of the trade) Test 5 b | Test tube no 3 (+ additive of the invention) Test 5 c |
|---|---|---|
| 50% | 95% | 15% |

It appears that the action of the conventional additive speeds up the settling of the paraffins of the considered gas-oil as compared with the same non-doped gas-oil, whereas the additive compositon according to the invention delays it substantially.

EXAMPLES 6 TO 11

In these examples, the nature of constituent (B) used in admixture with constituent $A_1$, described in example 1, is varied.

Table VII indicates the selective compositions for constituents (B).

TABLE VII

| Ref (B) | α-olefins cut | unsaturated α, β-dicarboxylic compound | ester of unsaturated acid | $\overline{M}_n$ | Product condensed on the terpolymer |
|---|---|---|---|---|---|
| $B_2$ | $C_{30}+$ | Maleic anhyd. | SMA | 2820 | butylamine |

TABLE VII-continued

| Ref (B) | α-olefins cut | unsaturated α, β-dicarboxylic compound | ester of unsaturated acid | $\overline{M}_n$ | Product condensed on the terpolymer |
|---|---|---|---|---|---|
| $B_3$ | $C_{24-28}$ | " | EHA | 2540 | ether-amine |
| $B_4$ | $C_{24-28}$ | " | EHA | 3200 | Primary and secondary diamine |
| $B_5$ | $C_{24-28}$ | " | EHA | 4450 | ethanolamine |
| $B_6$ | $C_{15-20}$ | " | SMA | 4300 | primary and tertiary diamine |

The terpolymer is formed of a molar equivalent of each of the three unsaturated compounds: α-olefins, maleic anhydride, ester of unsaturated acid. On this terpolymer is condensed a molar equivalent of the compound with primary amine group.

The α-olefins cuts may be defined by their average molecular weight and their content in their different constituents:

the $C_{30}+$cut, of average molecular weight 420, comprises approximately 22% of $C_{28}$ and lower α-olefins, 78% of $C_{30}$ and higher α-olefins.

the $C_{24-28}$ cut, of average molecular weight 364, comprises 1% of $C_{22}$ α-olefins, 30% of $C_{24}$ α-olefins, 39% of $C_{26}$ α-olefins, 20% of $C_{28}$ α-olefins, 10% of $C_{30}$ and higher α-olefins.

the $C_{15}$–$C_{20}$ cut, of average molecular weight 244, contains even and odd α-olefins, in proportion of 1% of $C_{14}$, 17% of $C_{15}$, 18% of $C_{16}$, 17% of $C_{17}$, 17% of $C_{18}$, 15% of $C_{19}$, 12% and $C_{20}$ and 3% of $C_{21}$.

The esters of unsaturated acids are methacrylates or acrylates: the SMA cut has been described in example 1.

EHA designates 2-ethyl hexyl acrylate.

The compounds with primary amine group are:

for constituent $B_3$, the N[(2,4,6-trimethyl decyl)3-oxy-1propyl)]1,3-diamino propane.

for constituent $B_4$, the N-alkyl 1,3 diamino propane whose alkyl chains contain about 1% of $C_{14}$, 5% of $C_{16}$, 42% of $C_{18}$, 12% of $C_{20}$, 40% of $C_{22}$.

for constituent $B_6$, the N,N-didodecyl 1,3 diamino propane.

The manufacture of constituents B has been described in example 1.

Constituents A and B have been tested alone and as mixtures in three proportions 75/25, 50/50, 25/75, in the three gas-oil cuts $G_1$, $G_4$, $G_6$ (wide).

The measured filterability limit temperatures are given in table VIII.

TABLE VIII

| No EXAMPLE | No TEST | COMPOSITION | FLT (°C.) $G_1$ | $G_4$ | $G_6$ |
|---|---|---|---|---|---|
| 6 | 6a | without additive | +2 | −1 | +2 |
| | 6b | 100 ppm $A_1$ | −3 | −5 | −5 |
| | 6c | 100 ppm $B_2$ | −1 | −2 | −3 |
| | 6d | 100 ppm $B_3$ | 0 | −2 | −3 |
| | 6e | 100 ppm $B_4$ | 0 | −3 | −4 |
| | 6f | 100 ppm $B_5$ | 0 | −1 | −3 |
| | 6g | 100 ppm $B_6$ | −1 | −3 | −4 |
| 7 | 7a | 75 ppm $A_1$ + 25 ppm $B_2$ | −6 | −10 | −11 |
| | 7b | 50 ppm $A_1$ + 50 ppm $B_2$ | −6 | −10 | −10 |
| | 7c | 25 ppm $A_1$ + 75 ppm $B_2$ | −4 | −7 | −6 |
| 8 | 8a | 75 ppm $A_1$ + 25 ppm $B_3$ | −6 | −7 | −9 |
| | 8b | 50 ppm $A_1$ + 50 ppm $B_3$ | −5 | −7 | −8 |
| | 8c | 25 ppm $A_1$ + 75 ppm $B_3$ | −3 | −5 | −5 |
| 9 | 9a | 75 ppm $A_1$ + 25 ppm $B_4$ | −5 | −8 | −8 |
| | 9b | 50 ppm $A_1$ + 50 ppm $B_4$ | −5 | −8 | −7 |
| | 9c | 25 ppm $A_1$ + 75 ppm $B_4$ | −3 | −6 | −5 |
| 10 | 10a | 75 ppm $A_1$ + 25 ppm $B_5$ | −6 | −9 | −10 |
| | 10b | 50 ppm $A_1$ + 50 ppm $B_5$ | −6 | −8 | −9 |
| | 10c | 25 ppm $A_1$ + 75 ppm $B_5$ | −4 | −5 | −6 |

TABLE VIII-continued

| No EXAMPLE | No TEST | COMPOSITION | FLT (°C.) $G_1$ | $G_4$ | $G_6$ |
|---|---|---|---|---|---|
| 11 | 11a | 75 ppm $A_1$ + 25 ppm $B_6$ | −6 | −13 | −13 |
| | 11b | 50 ppm $A_1$ + 50 ppm $B_6$ | −5 | −11 | −11 |
| | 11c | 25 ppm $A_1$ + 75 ppm $B_6$ | −3 | −7 | −8 |

All the values of the filterability limit temperatures show a more or less substantial synergism effect according to the nature of constituent (B). It appears that the best results correspond to a proportion of ethylene polymer ($A_1$) closer to 75% than to 50%.

What is claimed as the invention is:

1. A composition containing an additive usable for improving the cold filterability properties of oil middle distillates, said additive comprising:

a constituent (A) consisting essentially of at least one ethylene polymer having a number average molecular weight of 500–15,000, and a constituent (B) having a number average molecular weight of 1,000–10,000 and consisting essentially of at least one polymeric compound obtained by condensing a copolymer comprising:

(a) 15–40 mole % recurrent units from at least one linear α-olefin, (b) 20–70 mole % recurrent units deriving from at least one unsaturated α,β-dicarboxylic compound, as a diacid, light alkyl diester or anhydride; and (c) 15–40 mole % recurrent units from at least one alkyl ester of an unsaturated aliphatic monocarboxylic acid, or from at least one vinyl ester of a saturated aliphatic monocarboxylic acid, and (d) at least one compound having a primary amine group complying with one of the general formulas:

$$R—Z[(CH_2)_nNH]_mH \quad (I)$$

and $$HO—CH_2—R''—NH_2 \quad (II)$$

wherein R is a monovalent saturated aliphatic radical of 1–30 carbon atoms, Z is an —NH—, or —NR'— group, wherein R' is a saturated aliphatic monovalent radical of 1–30 carbon atoms, or the oxygen atom —O—, n is an integer from 2 to 4, m is an integer from 1 to 4 or is 0–4 when Z is NH, and R'' is a saturated aliphatic divalent radical of 1–18 carbon atoms whereby each of constituent (A) and constituent (B) is present as a distinct chemical entity, and with the proviso that the recurrent units (a) form an essentially random copolymer with units (b) or (c) or a mixture thereof.

2. An additive composition according to claim 1, wherein constituents (A) and (B) are in a ratio by weight from 1:20 to 20:1.

3. An additive composition according to claim 2, wherein said ratio by weight is from 1:5 to 5:1.

4. An additive composition according to claim 1, wherein said constituent (A) has a structure in accordance with the general formula:

$$CH_3[(CH_2)_m\underset{\underset{CH_3}{|}}{CH}(CH_2)_n]_pCH{=}CH_2$$

wherein m and n are each an integer from 1 to 20 and p is an integer from 3 to 30, the sum of m+n being from 9 to 34.

5. An additive composition according to claim 1, wherein in said constituent (B), the linear α-olefin from which the recurrent units (a) originate contains at least 16 carbon atoms; the unsaturated α,β-dicarboxylic compound from which originate the recurrent units (b) consist of at least one maleic or alkylmaleic acid, one methyl, ethyl or propyl diester of such acid or a maleic or alkylmaleic anhydride; and the ester from which originate the recurrent units (c) consists of at least one alkyl acrylate or methacrylate of 4–30 carbon atoms or of at least one vinyl ester of a saturated aliphatic monocarboxylic acid of 2–22 carbon atoms.

6. An additive composition according to claim 1, wherein the compound with primary amine group (I) or (II) used in the formation of said constitutent (B) is a primary amine of the formula R $NH_2$, wherein R is a linear alkyl radical of 12≧24 carbon atoms;

a polyamine of the formula:

$$R—NH[(CH_2)_nNH]_mH$$

wherein R is a linear alkyl radical of 12–24 carbon atoms, n is an integer from 2 to 4 and m an integer from 1 to 4;

a polylamine of the formula:

$$R—NR'[(CH_2)_nNH]_mH$$

wherein R and R' are each a linear alkyl radical of 8–24 carbon atoms, R and R' containing together 16 to 32 carbon atoms, n is an integer from 2 to 4 and m an integer from 1 to 4;

an ether-amine of the formula:

$$R—O[(CH_2)_nNH]_mH$$

wherein R is an alkyl radical of 12–24 carbon atoms, n is an integer from 2 to 4 and m an integer from 1 to 4; or an amino-alcohol of the formula:

$$HO—CH_2—R''—NH_2$$

wherein R'' is a linear or branched alkylene radical of 1 to 18 carbon atoms.

7. An additive composition according to claim 1, wherein the proportion of primary amine compound (I) or (II) involved in the formation of constituent (B) is from 0.9 to 1.1 mole per recurrent unit derived from unsaturated, α,β-dicarboxylic compound.

8. A method of decreasing the filterability limit temperature of an oil middle distillate, comprising adding to said middle distillate an effective proportion of an additive composition according to claim 1.

9. A method according to claim 8, wherein said middle distillate consists essentially of a gas-oil cut and the proportion of said additive composition is from 50–500 ppm.

10. A method according to claim 8, wherein the effective proportion of the additive composition is 20–2000 ppm.

11. A method according to claim 8, wherein the oil middle distillate has a distillation range according to ASTM-D-1160 of 160°–235° C. to 355°–440° C. at atmospheric pressure.

12. A composition according to claim 1 comprising an oil middle distillate and 20–2000 ppm of said additive.

13. A composition according to claim 5, wherein in said constituent (B), the linear α-olefin from which the recurrent units (a) originate is a mixture of linear α-olefins having 20–24 carbon atoms, a mixture of linear α-olefins having 24–28 carbon atoms, or a mixture containing about 20% b.w. of α-olefins having 28 carbon atoms or less and about 80% b.w. of α-olefins having 30 carbon atoms or more; the alkyl acrylate or methacrylate from which the recurrent units (c) originate is a butyl, ethylhexyl, decyl, dodecyl, hexadecyl, octadecyl or eicosyl acrylate or methacrylate; or the vinyl ester of a saturated aliphatic monocarboxylic acid from which the recurrent units (c) originate is vinyl acetate, vinyl propionate, vinyl butyrate or vinyl stearate.

14. A composition according to claim 6, wherein the polyamine is: N-dodecyl-1,3-diamino propane, N-tetradecyl 1,3-diamino propane, N-hexadecyl 1,3-diamino propane, N-octadecyl 1,3-diamino propane, N-eicosyl 1,3-diamino propane, N-docosyl 1,3-diamino propane, N-hexadecyldipropylene triamine, N-octacdecyl dipropylene triamine, N-eiscosyldipropylene triamine or N-docosyldipropylene triamine.

15. A composition according to claim 6, wherein the polyamine is: N,N-diethyl 1,2-diamino ethane, N,N-diisopropyl 1,2-diamino ethane, N,N-dibutyl 1,2-diamino ethane, N,N-diethyl 1,4-diamino butane, N,N-dimethyl 1,3-diamino propane, N,N-diethyl, 1,3-diamino propane, N,N-dioctyl 1,3-diamino propane, N,N-didecyl 1,3-diamino propane, N,N-didodecyl 1,3-diamino propane, N,N-ditetradecyl 1,3-diamino propane, N,N-dihexadecyl 1,3-diamino propane, N,N-dioctadecyl 1,3-diamino propane, N,N-didodecyldipropylenetramine, N,N-ditetradecyldi-propylenetriamine, N,N-dihexadecyldipropylenetriamine or N,N-dioctadecyldipropylenetriamine.

16. A composition according to claim 6, wherein the ether-amine is: 2-methoxy ethylamine, 3-methoxy propylamine, 4-methoxy butylamine, 3-ethoxy propylamine, 3-octyloxy propylamine, 3-decyloxy propylamine, 3-hexadecyloxy propylamine, 3-eicosyloxy propylamine, 3-docosyloxy propylamine, N-(3-octyloxy propyl)1,3-diamino propane, N-(3-decyloxy propyl)1,3-diamino propane, (2,4,6-trimethyl decyl)3-oxy propylamine or N-[2,4,6-trimethyl decyl)3-oxypropyl]1,3-diamino propane.

17. A composition according to claim 6, wherein the aminoalcohol is: monoethanolamine, 1-amino-3-propanol, 1-amino-4-butanol, 1-amino-5-pentanol, 1-amino-6-haxanol, 1-amino-7-heptanol, 1-amino-8-octanol, 1-amino-10-decanol, 1-amino-11-undecanol, 1-amino-13-tridecanol, 1-amino-14-tetradecanol, 1-amino-16-hexadecanol, 2-amino-2-methyl 1-propanol, 2-amino-1-butanol and 2-amino-1-pentanol.

18. A composition according to claim 6, wherein the amine is a primary amine being dodecylamine, tetradecylamine, hexadecylamine, octadecylamine, eicosylamine or docosylamine.

19. A composition according to claim 4, wherein the ethylene polymer as a number average molecular weight from 1,000 to 5,000.

* * * * *

UNITED STATES PATENT AND TRADEMARK OFFICE

CERTIFICATE OF CORRECTION

PATENT NO. : 4,664,676

DATED : 5-12-87

INVENTOR(S) : Jacques Denis et al

It is certified that error appears in the above-identified patent and that said Letters Patent is hereby corrected as shown below:

Column 1, line 18:

reads: "art, as additives for improving the behavior at tempera-"

should read: --art, as additives for improving the behavior at cold tempera--

Column 3, Line 21:

reads: "British patent BG No. 1,469,016 mentions a synergic"

should read: --British patent GB No. 1,469,016 mentions a synergic--

Signed and Sealed this

First Day of December, 1987

*Attest:*

DONALD J. QUIGG

*Attesting Officer*

*Commissioner of Patents and Trademarks*